US005324418A

United States Patent [19]

Muldowney

[11] Patent Number: 5,324,418

[45] Date of Patent: Jun. 28, 1994

[54] FCC PROCESS USING HIGH CAT:OIL RATIOS

[75] Inventor: Gregory P. Muldowney, Glen Mills, Pa.

[73] Assignee: Mobil Oil Corporation, Fairfax, Va.

[21] Appl. No.: 1,682

[22] Filed: Jan. 7, 1993

[51] Int. Cl.[5] ..... C10G 11/18; C10G 11/05

[52] U.S. Cl. ..... 208/120; 208/113; 208/132; 208/118; 208/159

[58] Field of Search ..... 208/48 Q, 157, 85, 67, 208/120, 113, 108, 73, 78, 61, 114, 111, 154, 132, 159

[56] References Cited

U.S. PATENT DOCUMENTS 4,800,014 1/1989 Hays et al. ..... 208/157
4,960,503 10/1990 Haun et al. ..... 208/85
5,073,249 12/1991 Owen ..... 208/48 Q

OTHER PUBLICATIONS

Speight, James G., *The Chemistry and Technology of Petroleum*, Marcel Dekker, Inc., New York (1990).

Ind. Eng. Chem. Res., vol. 29, No. 6 1990 "Development of Catalytic Cracking Technology . . . " Avidan et al.

*Primary Examiner*—R. Bruce Breneman
*Assistant Examiner*—Bekir L. Yildirim
*Attorney, Agent, or Firm*—Alexander J. McKillop; Malcolm D. Keen; Richard D. Stone

[57] ABSTRACT

A process for fluidized catalytic cracking of heavy feed to minimize yields of heavy fuel oil is disclosed. Operating a reactor with a 15:1 to 30:1 cat:oil ratio, at a reactor temperature of 1000° to 1100° F., and 1.5 to 5.0 seconds of catalyst residence time produces large volumes of gasoline and less than 5.0 wt % heavy fuel oil. A catalyst cooler is essential, to provide cool catalyst to the riser while permitting the regenerator to operate at 1200° F. or higher. FCC catalyst with over 25 wt % large pore zeolite is preferred.

17 Claims, 3 Drawing Sheets

FCC PROCESS USING HIGH CAT:OIL RATIOS

FIELD OF THE INVENTION

This invention relates to fluid catalytic cracking.

BACKGROUND OF THE INVENTION

Many modern refineries devote extraordinary amounts of energy and operating expense to convert most of a whole crude oil feed into high octane gasoline. The crude is fractionated into a virgin naphtha fraction which is usually reformed, and gas oil and/or vacuum gas oil fraction which are catalytically cracked in a fluidized catalytic cracking unit (FCC) unit.

A solid cracking catalyst in a finely divided form, with an average particle size of about 60–75 microns, is used. When well mixed with gas, the catalyst acts like a fluid (hence the designation FCC) and may be circulated in a closed flow loop between a cracking zone and a separate regeneration zone.

The Kellogg Ultra Orthoflow converter, Model F, shown in FIG. 1 of this patent application, and also shown as FIG. 17 of the Jan. 8, 1990 *Oil & Gas Journal,* is an example of a modern, efficient FCC unit. This design (and many other FCC designs not shown) converts a heavy feed into a spectrum of valuable cracked products in a riser reaction in 4–10 seconds of catalyst residence time.

In the cracking zone, hot catalyst contacts the feed to heat the feed, effect the desired cracking reactions and deposit coke on the catalyst. The catalyst is then separated from cracked products which are removed from the cracking reactor for further processing. The coked catalyst is stripped and then regenerated.

A further description of the catalytic cracking process may be found in the monograph, "Fluid Catalytic Cracking with Zeolite Catalysts", Venuto and Habib, Marcel Dekker, New York, 1978, incorporated by reference.

The FCC process is an efficient converter of heavy feed to lighter products, and has some favorable peculiarities. The FCC unit rejects the worst components of the feed as coke and regenerates the catalyst by burning this coke to supply the heat needed for the endothermic cracking reaction. On a volume basis it makes more product than feed. This "swell"—the expanded volume of liquid products after cracking a heavy feed—is one reason the process is so profitable.

Most refiners try to optimize the profitability of their FCC units, either by to maximizing swell or minimizing the yield of low value, heavy fuels. The preferred approach depends on the season. In winter there is considerable demand for heavy fuel and less for gasoline, hence it is usually most profitable to produce more heavy fuel and bottoms fractions off the FCC. In summer, gasoline demand is high and heavy liquid fuels are less valuable. Therefore, refiners usually try to minimize production of heavy fuel fractions such as light and heavy cycle oil and bottom fractions such as slurry oil. These materials, which can simply be looked on as the 650° F. and heavier liquid products, are the least valuable products of an FCC unit. Unfortunately they tend to be produced in significant amounts, especially when poor quality feeds containing large amounts of residual material are fed to the FCC unit.

Refiners have tried to improve yields in catalytic cracking by changing catalyst and reaction conditions. Essentially all refiners currently use zeolite cracking catalyst. In the 70's, use of catalyst with perhaps 10 wt % Y zeolite was common, but today many units use makeup catalyst with 30 to 40 wt % Y zeolite.

Partially in concert with these higher activity catalyst, FCC units have evolved toward ever shorter reaction times. From dense bed cracking, to hybrid units with both dense bed and riser cracking, to modern units with riser cracking alone. Effective reaction time has also been reduced by quick separation of cracked products from spent catalyst exiting the riser. The trend to shorter contact times continues.

Reduction in contact time beyond the point balanced by higher catalyst activity has led to increases in regenerated catalyst temperature. This is also due to the conviction that extremely hot catalyst can "shatter" the asphaltene molecules found in ever larger quantities in today's FCC feeds. Recently —two- stage—regenerators have been developed which achieve regenerated catalyst temperatures of 1400°–1500° F.

The patent literature is replete with references to short contact time cracking, but almost all commercial units today operate with riser reactors, 4 to 10 seconds of catalyst residence time, riser top temperatures of about 950° to 1025° F., and 4:1 to 8:1 cat:oil weight ratios.

In seeking to develop a viable short contact time cracking process, I reviewed internal studies which had investigated cracking at higher temperatures and/or shorter contact times. Much of the work was inconclusive either because contradictory results were obtained in different studies, or because a tradeoff was identified which made it impossible to generalize on the benefits of the new operating conditions. For example, one study showed gasoline selectivity reached an optimum at 3 seconds contact time, but octane was lower by 1 to 3 numbers depending on catalyst. Other work in the 3–7 second contact time range showed that higher temperature reduced both coke and gasoline selectivities, while a follow-up study showed gasoline selectivity increased monotonically at short contact time within the range of 3 to 7 seconds.

From this review I concluded that current cracking conditions, although used for decades in more than 100 FCC units, were not the best. I did additional work in a laboratory FCC riser pilot unit, and discovered that the best way to minimize bottoms yields in an FCC unit was not short contact time at all. I learned that cooler rather than hotter catalyst gave better conversion of heavy feeds, and that longer rather than shorter catalyst residence times were necessary to balance the reactions occurring in the riser. However, the most important factor was to use extraordinary amounts of catalyst—far more than typically used in a commercial FCC unit—at a temperature below that which could be produced in any commercial FCC regenerator. This improbable mix of conditions—more catalyst than had ever been used before, a temperature lower than any modern FCC regenerator can operate at, and preferably a feed inlet temperature exceeding that reachable by conventional FCC feed preheaters—minimized yields of low value heavy products. My process did not require, and in fact would not work with, very short contact times such as less than 1 or 2 seconds catalyst residence time.

BRIEF SUMMARY OF THE INVENTION

Accordingly, the present invention provides a process for the fluidized catalytic cracking of a feed containing hydrocarbons boiling above 650° F. comprising: preheating said feed to a temperature above 650° F. to produce a preheated feed; charging to an inlet portion of a cracking reactor said preheated feed and a stream of cooled, regenerated fluidized catalytic cracking catalyst containing at least 25 wt % large pore zeolite, based on the zeolite content of makeup catalyst to said cracking unit, and wherein the weight ratio of cooled, regenerated catalyst to preheated feed is at least 15:1 and produces a catalyst and feed mixture having a mix temperature of at least 1000° F. but below 1150° F.; cracking said mixture in said reactor for a catalyst residence time of 1.5 to 4.0 seconds to produce a mixture of cracked products and spent catalyst which are discharged from said reactor at a temperature between 1010° and 1075° F.; separating said discharged mixture to produce a stream of catalytically cracked products which are removed as a product and a stream of spent catalyst containing entrained and absorbed catalytically cracked products and coke; stripping said spent catalyst in a stripping means by contact with a stripping gas at stripping conditions to produce stripped catalyst; regenerating said stripped catalyst in a catalyst regeneration means at catalyst regeneration conditions including a temperature above 1200° F. and contact with an oxygen containing gas to burn coke from spent catalyst, and producing regenerated catalyst having a temperature above 1200° F.; and cooling said regenerated catalyst in a catalyst cooling means to produce cooled regenerated catalyst having a temperature below 1200° F.; recycling said cooled regenerated catalyst to said cracking reactor to contact said feed.

In a more limited embodiment, the present invention provides a process for the fluidized catalytic cracking of a feed containing at least 40 wt % hydrocarbons boiling above 900° F. and at least 2.0 wt % Conradson Carbon Residue to lighter products including less than 5.0 wt % hydrocarbons boiling above 650° F. comprising: preheating said feed to a temperature above 700° F. to produce a preheated feed; charging to an inlet portion of a cracking reactor said preheated feed and a stream of cooled, regenerated fluidized catalytic cracking catalyst containing at least 30 wt % large pore zeolite, based on the zeolite content of makeup catalyst to said cracking unit, and wherein the weight ratio of cooled, regenerated catalyst to preheated feed is at least 16:1 and produces a catalyst and feed mixture having a mix temperature of at least 1000° F. but below 1150° F.; cracking said mixture in said reactor for a catalyst residence time of 2 to 3 seconds to produce a mixture of cracked products and spent catalyst which are discharged from said reactor at a temperature between 1010° and 1075° F.; separating said discharged mixture to produce a stream of catalytically cracked products which are removed as a product and a stream of spent catalyst containing entrained and absorbed catalytically cracked products and coke; stripping said spent catalyst in a stripping means by contact with a stripping gas at stripping conditions to produce stripped catalyst; regenerating said stripped catalyst in a catalyst regeneration means at catalyst regeneration conditions including a temperature above 1250° F. and contact with an oxygen containing gas to burn coke from spent catalyst, and producing regenerated catalyst having a temperature above 1250° F.; and cooling said regenerated catalyst in a catalyst cooling means to produce cooled regenerated catalyst having a temperature below 1150° F.; recycling said cooled regenerated catalyst to said cracking reactor to contact said feed.

DETAILED DESCRIPTION

Figure 1:
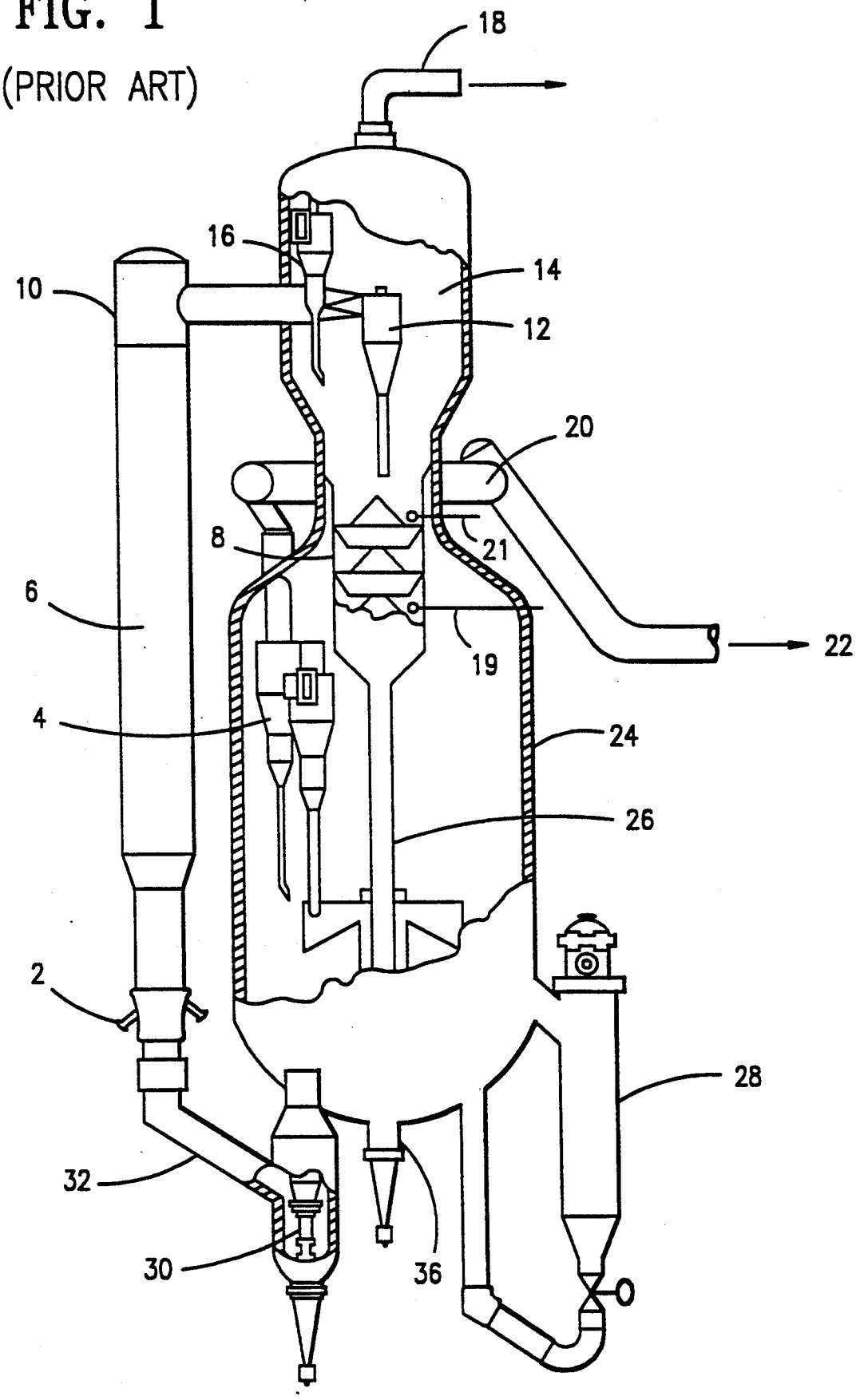
FIG. 1 (PRIOR ART)
FIG. 1 (prior art) is a simplified schematic of an FCC unit of the prior art.

The basics of the FCC process will now be reviewed in conjunction with a review of FIG. 1 (prior art) which is similar to the Kellogg Ultra Orthoflow converter Model F shown as FIG. 17 of Fluid Catalytic Cracking Report, in the Jan. 8, 1990 edition of *Oil & Gas Journal.*

A heavy feed such as a gas oil or vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14 and eventually is removed via upper cyclones 16 and conduit 18 to the fractionator.

Spent catalyst is discharged down from a dipleg of riser cyclones 12 into catalyst stripper 8 where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28, withdrawing from and discharging to the regenerator dense bed, is provided so heat may be removed from the regenerator if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, is discharged into a dilute phase region in the upper portion of regenerator 24. Entrained catalyst is separated from flue gas in multiple stages of cyclones 4, and discharged via outlets 8 into plenum 20 for discharge to the flare via line 22.

The process of the present invention can be conducted in such a conventional apparatus, provided the diameter of various pieces of equipment is increased to handle the greatly increased catalyst traffic required, and provided a catalyst cooler is installed on the return line from the regenerator to cool the catalyst between the regenerator outlet and the riser reactor inlet. The cooler is essential to my process because the required temperature of the generated catalyst sent to the reactor is so low that the regenerator would not effectively combust the coke on the spent catalyst at that temperature. My process requires a typical regenerator temperature such as above 1200° F., and preferably above 1300° F. but cannot use catalyst this hot in the reactor, hence a catalyst cooler is needed in between.

Having provided an overview of the FCC process, additional details will be provided about catalyst and process conditions.

CRACKING CATALYST

It is essential to use a highly active cracking catalyst. The catalyst zeolite content, as measured by the large pore, or Y zeolite content of the makeup catalyst, should be at least 25 wt %, more preferably at least 30 wt % and most preferably at least 40 wt %. While such catalysts are not per se novel, they are very important to achieving the desired results.

The process also works well with additives, such as those designed to adsorb SOx, to increase octane and olefin yields (ZSM-5), or to promote CO combustion. These are all conventional.

CRACKING REACTOR

A conventional riser cracking reactor can be used, provided it can operate with a residence time of at least 2 to 4 or 5 seconds, and preferably with 2.5 to 3.5 seconds. About 3 seconds of catalyst residence time is optimal. Commercial riser reactors operate with 1.0 to 5.0 seconds of vapor residence time, with catalyst residence times being 2 to 3 times higher because of catalyst slip in the riser. Use of increased atomization steam, reduced reactor pressure, a smaller riser diameter, or feed addition higher up in the riser reactor are some ways to achieve the desired catalyst and reactant residence time.

Either upflow or downflow reactors may be used. Upflow reactors are preferred on the present invention because gravity acts opposite to the direction of solids flow, thereby increasing the effective catalyst density at the point of oil injection. The process will work with a downflow reactor, but the full benefits may not be realized.

FEED MIXING NOZZLES

Efficient contacting of feed with catalyst is very important in the process of the present invention. While the patent and technical literature mentions the importance of effective feed nozzles, most commercial units have nozzles of rather low efficiency due to the conviction that simplicity of design is paramount.

Good nozzles are available from the M. W. Kellogg Co. and from other vendors. Conventional nozzles involving high pressure drops or large amounts of atomizing steam can also be used.

An effective feed nozzle should produce droplets of a sufficiently small size that at riser conditions the feed is over 90% vaporized in less than 0.1 second, and preferably in less than 0.05 second from the time of injection.

REACTOR CONDITIONS

The process requires operating the cracking reactor so that the oil vapor residence time is 2.5 to 5.5 seconds with the appropriate catalyst residence time fixed by slip. The reaction temperature, defined as the reactor outlet temperature, must be in a relatively narrow range: from 1000° to 1100° F. preferably from 1010° to 1075° F., and most preferably from 1010° to 1050° F.

CAT:OIL RATIOS

The process of the invention requires that the reactor operate with unusually high (for conventional FCC units) catalyst to oil weight ratios, while remaining within the temperature limits described above.

Preferably the unit operates with a 15:1 to 30:1 cat:oil weight ratio, more preferably with a 16:1 to 25:1 ratio, and most preferably with a 16:1 to 20:1 cat:oil ratio in the reactor.

FCC FEED

The process works with any conventional heavy FCC feed, such as a vacuum gas oil. Conventional heavy FCC feeds could be defined as simply those hydrocarbons boiling above about 650° F.

Surprisingly, the process will also work with very heavy feeds, containing significant amounts of residual material, e.g., atmospheric or vacuum resids.

My process does not seem to convert the CCR material in the resid. Roughly 75 to 80% of this material will simply be converted to coke in the reactor, which is consistent with what happens to CCR in conventional FCC units. My process will ensure that material which is converted does not go to form excessive amounts of low value products such as heavy fuel oil or slurry oil.

Thus in addition to conventional distilled feeds, the process will handle resids, which can be broken down into three classes.

Class 1 resids are those feeds having less than 2.0 wt % CCR, and a Ni+V content of 10 ppm or less. Gippsland is an example, but unique in having no CCR. Such materials can be processed in a conventional FCC unit without equipment modifications.

Class 2 resids are those feeds having from about 2 to 7 wt % CCR material, and under 20 ppm Ni+V. Examples are Statfjord and Beryl resids. These can be processed in an FCC unit, but usually some sort of catalyst cooler is needed in the regenerator.

Class 3 resids have either more than 7 wt % CCR material, or more than 20 ppm Ni+V. Examples are Arab Light, Arab Heavy, West Texas Sour and Maya. These resids require a cat cooler and feed hydrotreating.

Although the process of the present invention will work to convert even these heavy feeds to a spectrum of liquid products having less than 5 wt % heavy fuel oil, it should be recognized that running some of the crudes at least would require massive amounts of catalyst makeup, or a DEMET unit to remove metals, or some sort of metals passivation additive or combination approach.

FEED PREHEAT

The process of the present invention can operate with conventional feeds heated to conventional temperatures—typically to about 600°-700° F. However, the process will work better when the feed is preheated above 700° F., preferably above 725° F., and most preferably above 800° F. In most refineries, the feed preheat limit is about 700° F., whereupon thermal cracking becomes possible. Modification of the preheater may be needed to achieve the desired feed inlet temperature without fouling or coking the heater. Some form of solvent addition, such as a hydroaromatic, may be advantageous for this purpose. Alternatively, a higher heat transfer efficiency may be achieved through modification so that the feed is exposed to high temperatures for a shorter period of time. The preferred feeds for this process are atmospheric resids, which contain sufficient vacuum gas oil to act as "cutter stock" so that solvent addition will not usually be necessary.

CATALYST COOLING

It is essential to cool the regenerated catalyst so that the high cat:oil ratios used in the process do not result in too high a riser bottom mix temperature. The regenerated catalyst temperature is preferably below 1200° F. more preferably below 1175° F., and most preferably below 1150° F. The process works best when the temperature of catalyst charged to the riser reactor is around 1125°, plus or minus 25° F. However, this temperature is too low for the FCC regenerator to maintain coke burning rates. Hence the regenerator must be run within a conventional temperature range and the catalyst cooled between the regenerator outlet and the reactor inlet.

EXAMPLES

Extensive pilot plant tests were conducted in a riser cracking pilot plant test apparatus cracking a Statfjord atmospheric resid using commercial equilibrium catalyst.

TABLE 1

| Properties of Statfjord Atmospheric Resid | |
|---|---|
| API Gravity | 24.0 |
| CCR, wt % | 2.33 |
| Ni, ppm wt | 1.9 |
| V, ppm wt | 3.1 |
| Na, ppm wt | 12.0 |
| S, ppm wt | 5000 |
| N, ppm wt total | 1400 |
| N, ppm wt basic | 527 |
| Distillation, °F. | |
| IBP | 465 |
| 5% | 583 |
| 10% | 640 |
| 20% | 709 |
| 30% | 761 |
| 40% | 808 |
| 50% | 855 |
| 60% | 907 |
| 70% | 979 |
| 80% | 1000 |

TABLE 2

| Equilibrium Catalyst Properties | |
|---|---|
| Carbon Content (As Received), % | 0.0756 |
| Density | |
| Packed, g/cc | 0.96 |
| Particle, g/cc | 1.385 |
| Real, g/cc | 2.648 |
| Pore Volume, cc/g | 0.34 |
| Surface Area, $m^2/g$ | 124 |
| Unit Cell Lattice Parameter, A | 24.32 |
| Metals Content | |
| Nickel, ppm | 600 |
| Vanadium, ppm | 1000 |
| Magnesium, ppm | 3000 |
| Antimony, ppm | <900 |
| Copper, ppm | 250 |
| Iron, ppm | 7000 |
| Sodium, ppm | 18000 |
| Clean-Burned FAI Results | |
| Conversion, vol % | 66.2 |
| $C_5$+ Gasoline Yield, vol % | 58.2 |
| $C_4$s Yield, vol% | 11.2 |
| Dry Gas Yield, wt % | 4.1 |
| Coke Yield, wt % | 0.96 |
| $C_{letgo}$, wt % | 0.431 |

Example 1 (Prior Art). The pilot plant unit was operated at conventional conditions: a riser top temperature of 1010° F., a catalyst contact time in the riser of 3.1 seconds, a feed preheat temperature of 706° F. and a cat:oil ratio of 4.5:1 wt:wt. The FCC heat balance under these conditions leads to a catalyst inlet temperature of 1280° F. Yields are presented in Table 3.

Example 2 (invention). The pilot plant unit was operated at conditions to minimize heavy fuel oil yields. Operating conditions were 1075°-1076° F. riser top temperature, 1.7-1.75 seconds catalyst residence time, feed preheat temperature of 709° to 717° F., and cat-to-oil ratios of 16.1 and 21.7. Under these conditions a catalyst inlet temperature of 1140° to 1157° F. is required—121° to 140° F. lower than Example 1. Yields appear in Table 4.

Figure 2:
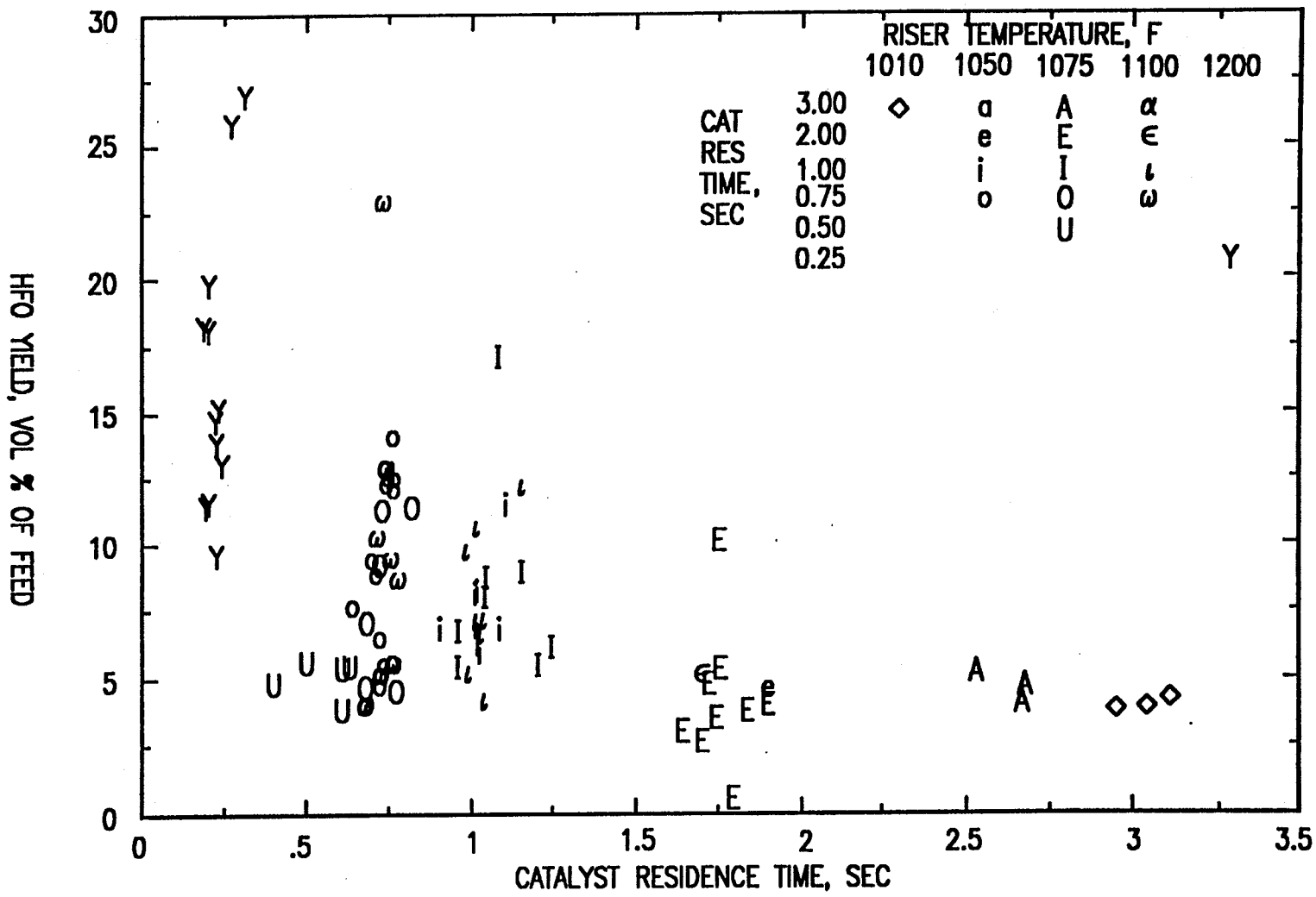
FIG. 2 (invention) shows a plot of heavy fuel oil yields at various catalyst residence times and riser temperatures.

FIG. 2 shows how yields of heavy fuel oil vary with different contact times and riser temperatures. It is seen that higher heavy fuel oil yields become more favored as contact time is reduced below 2.5 second. At any fixed contact time below 2.5 seconds, a large range of heavy fuel oil yields is possible, but the controlling variable is not reaction temperature. Rather it is found that heavy fuel oil yield varies inversely with cat-to-oil ratio. Thus to achieve heavy fuel oil yields below 5.0 vol % from a resid feed, a high cat-to-oil ratio is essential.

Figure 3:
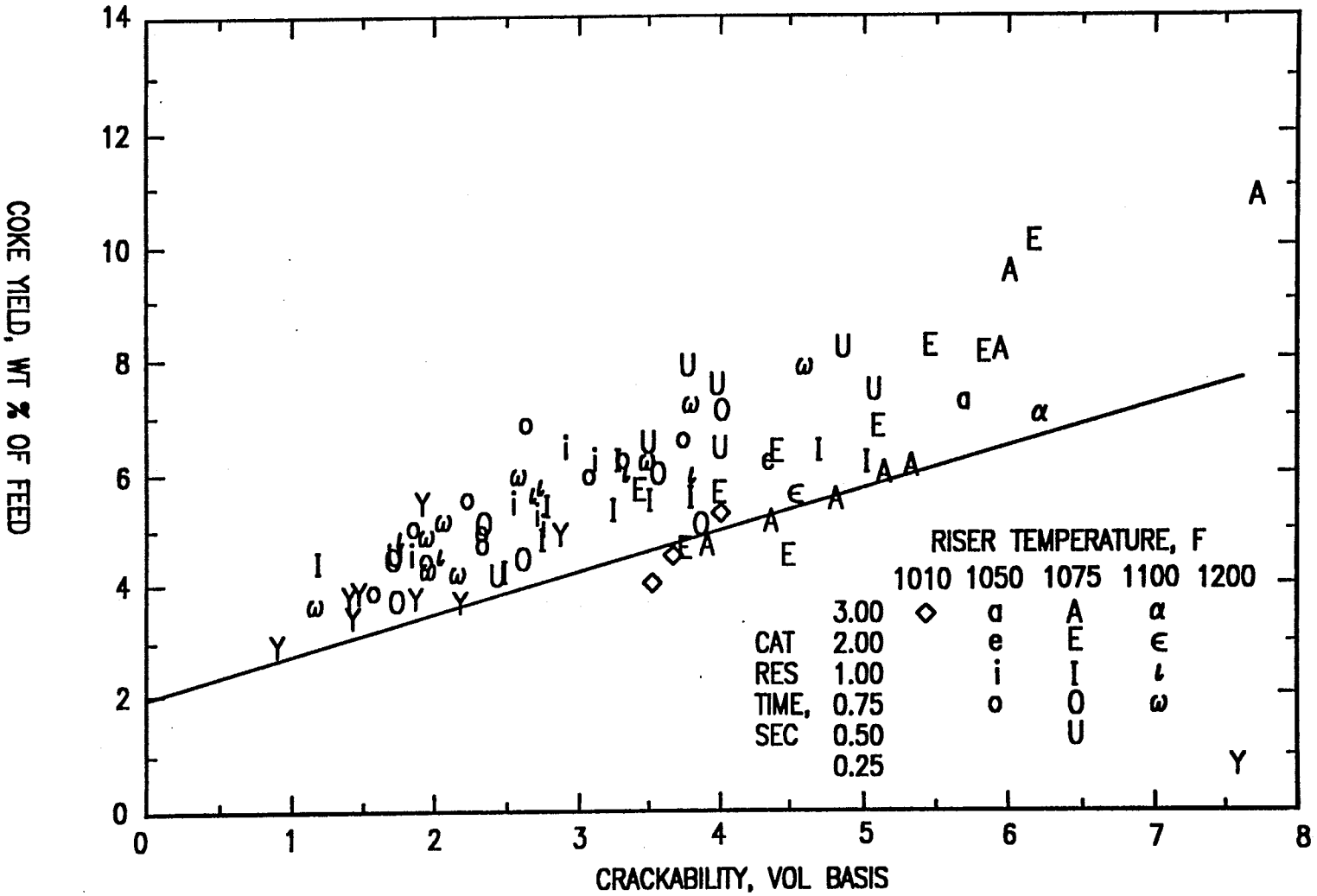
FIG. 3 (invention) presents coke yields at various catalyst residence times and riser temperatures.

FIG. 3 presents coke yields plotted in the familiar manner against crackability. Several points at 3.0 seconds, which correspond to very high conversions, show higher coke selectivity than conventional FCC conditions.

DISCUSSION

Considerably oversimplifying several years of research, I have the following observations as to why the invention works, and the best way to use it in new and existing FCC units. Conversion of high-boiling molecules requires that they be vaporized and that they contact catalyst, hence heat and mass transfer in the catalyst/oil mixing zone are deterministic. With regard to heat transfer, the three means of passing heat from the catalyst to the oil are conduction, convection, and radiation. In conduction and convection the heat flux varies with the temperature difference per unit length, while in radiation the flux depends on the difference of the temperatures to the fourth power, multiplied by a view factor. In a crude model of the riser, the catalyst particles may be considered to occupy the nodes of a cubic lattice. Increasing cat-to-oil ratio from 6 to 20 reduces the average interparticle distance by 50% and increases the number of particles per unit area by 122%. As seen in Examples 1 and 2, there is also a reduction in the temperature difference between catalyst and oil (in those cases) from 574° F. to 434° F., corresponding to a drop in the difference of fourth powers of temperature of 36%. Heat flux by convection and conduction therefore changes due to the higher C/O and cooler catalyst by $(434/574)\times 1.5$, and is 13% greater. Heat flux by radiation is changed by $(1-0.36)\times 2.22$ and is 42% greater. Thus the process of the present invention succeeds because the shifts in inlet conditions favor faster heat transfer from catalyst to oil, hence more rapid vaporization of the feed which is a prerequisite for reaction. The shorter interparticle distance also accelerates mass transfer of oil vapor to the catalyst surface.

I claim:

1. A process for the fluidized catalytic cracking of a feed containing hydrocarbons boiling above 650° F. comprising:

a) preheating said feed to a temperature above 650° F. to produce a preheated feed;

b) charging to an inlet portion of a cracking reactor said preheated feed and a stream of cooled, regenerated fluidized catalytic cracking catalyst containing at least 25 wt % large pore zeolite, based on the zeolite content of makeup catalyst to said cracking unit, and wherein the weight ratio of cooled, regenerated catalyst to preheated feed is at least 15:1 and produces a catalyst and feed mixture having a mix temperature of at least 1000° F. but below 1150° F.;

c) cracking said mixture in said reactor for a catalyst residence time of 1.5 to 4.0 seconds to produce a mixture of cracked products and spent catalyst which are discharged from said reactor at a temperature between 1010° and 1075° F.;

d) separating said discharged mixture to produce a stream of catalytically cracked products which are removed as a product and a stream of spent catalyst containing entrained and absorbed catalytically cracked products and coke;

e) stripping said spent catalyst in a stripping means by contact with a stripping gas at stripping conditions to produce stripped catalyst;

f) regenerating said stripped catalyst in a catalyst regeneration means at catalyst regeneration conditions including a temperature above 1200° F. and contact with an oxygen containing gas to burn coke from spent catalyst, and producing regenerated catalyst having a temperature above 1200° F.; and g) cooling said regenerated catalyst in a catalyst cooling means to produce cooled regenerated catalyst having a temperature below 1200° F.;

h) recycling said cooled regenerated catalyst to said cracking reactor to contact said feed.

2. The process of claim 1 wherein the mix temperature of catalyst and feed is 1025° to 1125° F., and the average temperature in the reactor is within the range of 1010° to 1100° F., and the catalyst has a residence time in the reactor of 1.5 to 4 seconds.

3. The process of claim 2 wherein the average temperature in the reactor is 1025° to 1075° F. and the catalyst residence time is 2 to 3 seconds.

4. The process of claim 1 wherein the feed is preheated to 750° F.

5. The process of claim 1 wherein the feed is preheated to 800° F.

6. The process of claim 1 wherein the feed is a resid and contains less than 2.0 wt % Conradson Carbon Residue and less than 10 wt ppm Ni+V.

7. The process of claim 1 wherein the feed is a resid and contains from 2.0 to 7.0 wt % Conradson Carbon Residue and less than 20 wt ppm Ni+V.

8. The process of claim 1 wherein the feed is a resid and contains more than 7.0 wt % Conradson Carbon Residue or more than 20 wt ppm Ni+V.

9. The process of claim 1 wherein the reactor is a riser reactor.

10. The process of claim 1 wherein the total yield of heavy fuel oil, defined as normally liquid hydrocarbons boiling above about 650° F., is less than 5.0 wt % of the 650° F.+ feed to the cracking reactor.

11. A process for the fluidized catalytic cracking of a feed containing at least 40 wt % hydrocarbons boiling above 900° F. and at least 2.0 wt % Conradson Carbon Residue to lighter products including less than 5.0 wt % hydrocarbons boiling above 650° F. comprising:

a) preheating said feed to a temperature above 700° F. to produce a preheated feed;

b) charging to an inlet portion of a cracking reactor said preheated feed and a stream of cooled, regenerated fluidized catalytic cracking catalyst containing at least 30 wt % large pore zeolite, based on the zeolite content of makeup catalyst to said cracking unit, and wherein the weight ratio of cooled, regenerated catalyst to preheated feed is at least 16:1 and produces a catalyst and feed mixture having a mix temperature of at least 1000° F. but below 1150° F.;

c) cracking said mixture in said reactor for a catalyst residence time of 2 to 3 seconds to produce a mixture of cracked products and spent catalyst which are discharged from said reactor at a temperature between 1010° and 1075° F.;

d) separating said discharged mixture to produce a stream of catalytically cracked products which are removed as a product and a stream of spent catalyst containing entrained and absorbed catalytically cracked products and coke;

e) stripping said spent catalyst in a stripping means by contact with a stripping gas at stripping conditions to produce stripped catalyst;

f) regenerating said stripped catalyst in a catalyst regeneration means at catalyst regeneration conditions including a temperature above 1250° F. and contact with an oxygen containing gas to burn coke from spent catalyst, and producing regenerated catalyst having a temperature above 1250° F.; and g) cooling said regenerated catalyst in a catalyst cooling means to produce cooled regenerated catalyst having a temperature below 1150° F.;

h) recycling said cooled regenerated catalyst to said cracking reactor to contact said feed.

12. The process of claim 11 wherein the mix temperature of catalyst and feed is 1025° to 1125° F., and the average temperature in the reactor is within the range of 1010° to 1100° F.

13. The process of claim 11 wherein the average temperature in the reactor is 1025° to 1075° F.

14. The process of claim 11 wherein the feed is preheated to 800° F.

15. The process of claim 11 wherein the feed is a resid and contains from 2.0 to 7.0 wt % Conradson Carbon Residue and less than 20 wt ppm Ni+V.

16. The process of claim 11 wherein the feed is a resid and contains more than 7.0 wt % Conradson Carbon Residue or more than 20 wt ppm Ni+V.

17. The process of claim 11 wherein the reactor is a riser reactor.

* * * * *